United States Patent [19]

Tanaka

[11] Patent Number: 4,765,290

[45] Date of Patent: Aug. 23, 1988

[54] VALVE ACTUATING DEVICE OF INTERNAL COMBUSTION ENGINE

[75] Inventor: Kunihiko Tanaka, Tokyo, Japan

[73] Assignee: Honda Giken Kogyo Kabushiki Kaisha, Tokyo, Japan

[21] Appl. No.: 66,939

[22] Filed: Jun. 25, 1987

[30] Foreign Application Priority Data

Jun. 25, 1986 [JP] Japan ..... 61-97355[U]

[51] Int. Cl.[4] ..... F01L 1/18

[52] U.S. Cl. ..... 123/90.42; 123/90.41

[58] Field of Search ..... 123/90.42, 90.43, 90.44, 123/90.41

[56] References Cited

U.S. PATENT DOCUMENTS

| | | | |
|---|---|---|---|
| 1,544,784 | 7/1925 | Thomas | 123/90.44 |
| 3,401,678 | 9/1968 | Rose | 123/90.42 |
| 3,841,280 | 10/1974 | Lussier | 123/90.42 |
| 4,418,659 | 12/1983 | Gaede | 123/90.44 |
| 4,491,099 | 1/1985 | Bonvallet | 123/90.41 |

FOREIGN PATENT DOCUMENTS

| | | | |
|---|---|---|---|
| 866872 | 5/1961 | United Kingdom | 123/90.41 |

*Primary Examiner*—Andrew M. Dolinar

*Attorney, Agent, or Firm*—Lyon & Lyon

[57] ABSTRACT

In a valve actuating device of an internal combustion engine having rocker arms pivoted at their base ends to a cylinder head in a freely oscillating manner and permitting a plurality of intake valves and a plurality of exhaust valves to be opened and closed by respective cam shafts through the operations of the respective rocker arms, a guide plate is fixed to the cylinder head at a location between the rocker arms and is formed with guide grooves for engagement with the tip ends of the rocker arms and allowing sliding motion of the rocker arms therein only in the opening and closing direction of the valves. This prevents sideward oscillation of the rocker arms.

4 Claims, 4 Drawing Sheets

VALVE ACTUATING DEVICE OF INTERNAL COMBUSTION ENGINE

BACKGROUND OF THE INVENTION

1. Field of the Invention

The present invention relates to a valve actuating device of an internal combustion engine of the type wherein between a plurality of parallel-arranged intake valves and an intake cam shaft driving and opening these valves are disposed a plurality of intake rocker arms which have their base ends pivoted to a cylinder head in a freely oscillating manner, and between a plurality of exhaust valves opposed to the intake valves and an exhaust cam shaft driving and opening the exhaust valves are disposed a plurality of exhaust rocker arms pivoted at base ends thereof to the cylinder head also in a freely oscillating manner.

2. Description of the Prior Art

In a valve actuating device of this kind, means must be provided to suppress sideward oscillation of each of the rocker arms and conventionally it has been proposed to form a longitudinal groove on a lower surface of the tip end of the rocker arm and keep the stem end of the valve engaged in that groove in order to prevent the oscillation of the rocker arm in a sideward direction.

With such conventional arrangement, a load from the rocker arm is applied sidewardly or in a lateral direction to the valve and this causes increase more or less in the burden to be borne by the valve itself and a valve guide for guiding slide motion of the valve. Accordingly, account must sufficiently be taken of the anti-wearing property of these valve components.

SUMMARY OF THE INVENTION

In view of these circumstances, the present invention has as its object the provision of a valve actuating device of the afore-mentioned type which is simple in structure and which includes rocker arms that are effectively prevented from sideward oscillation without burden being imposed onto associated valves and valve guides.

In order to achieve the above object, the invention is characterized by the features that a guide plate is fixed to an engine cylinder head at a position between two adjacent intake rocker arms and two exhaust rocker arms opposing thereto and guide grooves are formed in the guide plate to be engaged by tip ends of the four rocker arms in a manner slidable only in opening and closing directions of the valves.

Owing to this arrangement, adjacent two intake rocker arms and opposing two exhaust rocker arms can be guided and slide in the grooves of the guide plate during opening and closing motions of corresponding intake and exhaust valves and thus are always held abutted against the stem ends of the valves, being prohibited their sideward oscillation through function of the single guide plate.

The guide plate is fixed to the cylinder head so that any lateral load acting on the rocker arms can be supported by the cylinder head without being transmitted to the valves.

Moreover, a dead space present between two intake rocker arms and two exhaust rocker arms is utilized for the arrangement of a single large-sized guide plate extending over the four rocker arms. Therefore, in addition to a simplification of the structure, the assembling efficiency can be improved.

Objects, features and advantages pertaining to the invention other than the above will be apparent from reading of the following description of a preferred embodiment made in conjunction with the accompanying drawings.

BRIEF DESCRIPTION OF THE DRAWINGS

The attached drawings show one embodiment according to the present invention, wherein.

DESCRIPTION OF PREFERRED EMBODIMENT

Figure 1:
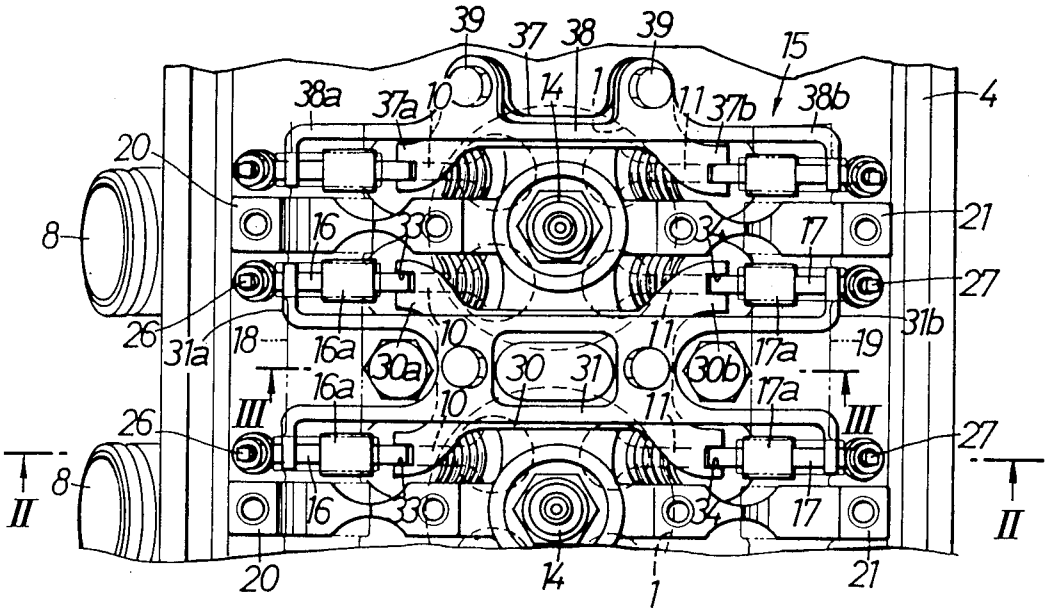
FIG. 1 is a plan view of a multi-cylinder type internal combustion engine equipped with a valve actuating device according to the invention.

Hereinafter one embodiment according to the invention will be explained with reference to the accompanying drawings. First referring to FIGS. 1 and 2, therein is shown a cylinder block 2 formed with a plurality of cylinders 1, 1 . . . . The cylinder block 2 is superposed and secured on its upper surface with a cylinder head 4 via a gasket 5, the cylinder head 4 being recessed with combustion chambers 3, 3 . . . at its lower surface which communicate with the cylinders 1, 1 . . . in the cylinder block 2, respectively.

Each combustion chamber 3 has a ceiling wall formed into the shape of chevron with its ridge line 6 extending centrally in the direction of array of the cylinders 1, 1. On one *7a* of the inclined surfaces defining the chevron-shaped ceiling wall are opened a pair of intake ports 8, 8 located parallel with each other along the ridge line 6 whereas on the other inclined surface *7b* are opened a pair of exhaust ports 9, 9 in a similar manner. Respective pairs of intake valves 10, 10 and exhaust valves 11, 11 adapted for opening and closing the intake ports 8, 8 and exhaust ports 9, 9, and valve springs 12, 12 and 13, 13 biassing the valves in their closing direction are mounted to the cylinder head 4. Mutually opposed intake and exhaust valves 10, 11 are arranged in a V-shaped configuration with the interval therebetween becoming larger toward their stem ends.

Ignition plugs 14, 14 . . . are further mounted in the cylinder head 4, of which electrodes are exposed to the central portions of the ceiling walls of respective combustion chambers 3.

Also in the cylinder head 4 is arranged a valve actuating device 15 for imparting opening actions to the intake and exhaust valves 10, 11. This valve actuating device 15 comprises intake rocker arms 16 having tip ends thereof abutted against the stem ends of respective intake valves 10 and base ends thereof pivoted to the cylinder head 4; exhaust rocker arms 17 having their tip ends abutted against the stem ends of respective exhaust valves 11 and their base ends pivoted to the cylinder head 4; a single intake cam shaft 18 having a plurality of intake cams 18*a*, 18*a* . . . provided thereon and placed in engagement with slipper surfaces 16*a*, 16*a* . . . which are formed on upper surfaces of the intake rocker arms 16, 16 . . . at intermediate portions thereof; and a single exhaust cam shaft 19 provided thereon with a plurality of exhaust cams 19*a*, 19*a* . . . coming into engagement with slipper surfaces 17*a*, 17*a* . . . which are formed on intermediate upper surfaces of the exhaust rocker arms 17, 17 . . . . The cam shafts 18 and 19 are rotatably supported between cam support bases 20, 21 formed on the upper part of the cylinder head 4 and cam holders 22, 23 fixed to the bases 20, 21 by bolts 24, 25.

The intake and exhaust rocker arms 16 and 17 are positioned opposed at their tip ends to each other and have their base ends screw-fitted with adjusting bolts 26 and 27 which are formed at their lower ends into spherical ends 26*a* and 27*a*. These spherical ends 26*a*, 27*a* are engaged in spherical recesses 28*a*, 29*a* of supporting members 28, 29, fixedly secured to the cylinder head 4, for free pivot or oscillating motion within the recesses.

Figure 3:
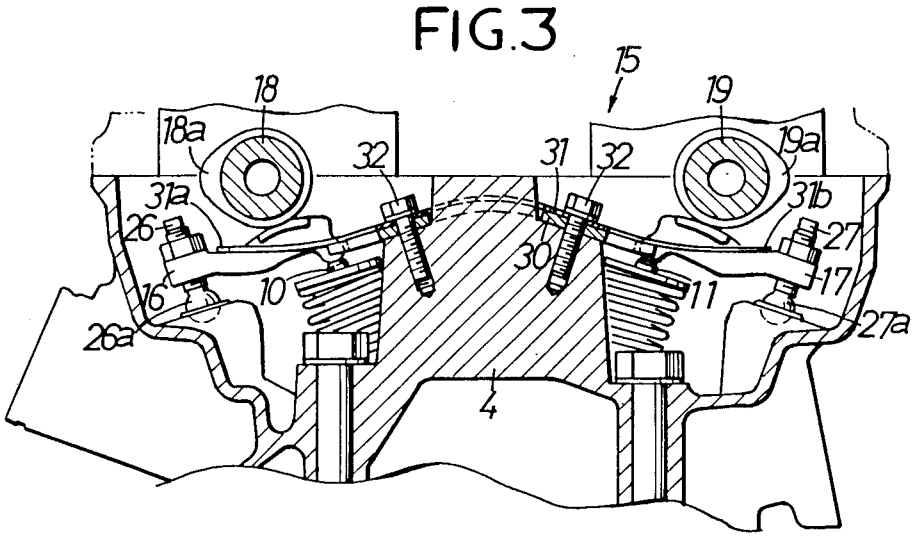
Figure 4:
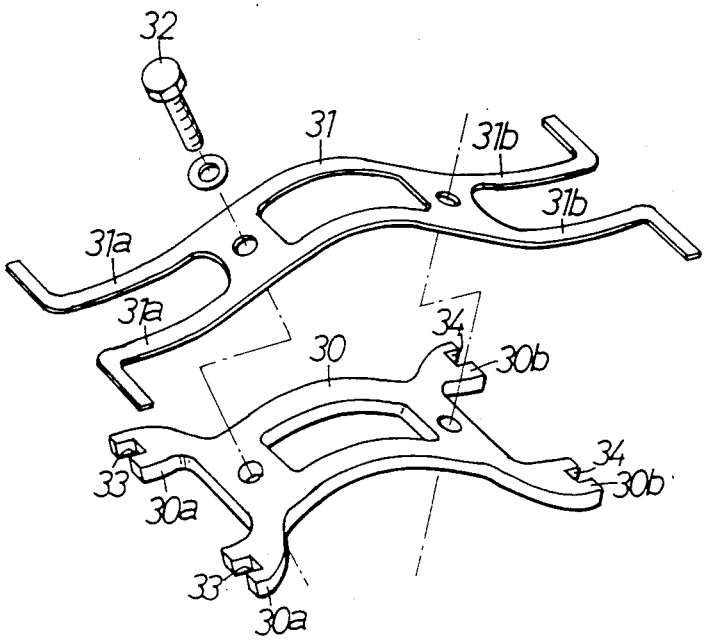
FIG. 4 is an exploded perspective view of an essential part of the device.

Between adjacent ignition plugs 14, 14 are arranged a guide plate 30, which serves to suppress sideward oscillation of respective two intake rocker arms 16, 16 and exhaust rocker arms 17, 17 located in opposition to each other between the said ignition plugs, and a vibration-proof spring 31 serving to suppress vertical vibratory movements of these rocker arms. As illustrated in FIGS. 3 and 4, the guide plate 30 is formed of a thick steel plate material and the vibration-proof spring 31 is of a leaf spring, these components being together fixed to the cylinder head 4 in a unitary fashion by two bolts 32, 32 with the spring 31 laid on the guide plate 30.

The guide plate 30 is branched at its opposite ends into respective pairs of arms 30*a*, 30*a*; 30*b*, 30*b*. One pair of arms 30*a*, 30*a* are formed with vertical guide grooves 33, 33 into which the tip ends of the adjacent two intake rocker arms 16, 16 engage in a vertically slidable manner. The other pair of arms 30*b*, 30*b* are formed with vertical guide grooves 34, 34 which similarly receive the tip ends of the adjacent two exhaust rocker arms 17, 17 so as to permit their vertical sliding motion in the grooves.

Meanwhile, the vibration-proof spring 31 is at its opposite ends branched into respective pairs of press arms 31*a*, 31*a*; 31*b*, 31*b*. Further, the press arms of each pair are bent at their free ends in a lateral direction apart from each other. The bent ends of one pair of the press arms 31*a*, 31*a* are resiliently retained on the upper surfaces of the adjacent two intake rocker arms 16, 16 at positions intermediate between the slipper surfaces 16*a* and the adjusting bolts 26, respectively. The bent ends of the other pair of the press arms 31*b*, 31*b* are resiliently retained on the upper surfaces of the adjacent two exhaust rocker arms 17, 17 at positions between the slipper surfaces 17*a* and the adjusting bolts 27, respectively.

As shown in FIG. 1, in order to prevent sideward oscillation and vertical vibration of the two intake and exhaust rocker arms 16 and 17 located on the outermost position on the cylinder head 4, a guide plate 37 and a vibration-proof spring 38 are fixed by a pair of bolts 39, 39 to the cylinder head 4 adjacently to the outer side of the outermost ignition plug 14. The guide plate 37 has almost the same structure as the guide plate 30 except that it has only two arms 37*a*, 37*b* provided corresponding to the two intake and exhaust rocker arms 16, 17 on the outermost side. Similarly, the vibration-proof spring 38 has only two press arms 38*a*, 38*b* for the said two rocker arms 16, 17 but is substantially the same as the aforementioned vibration-proof spring 31 in its remaining structure.

Figure 2:
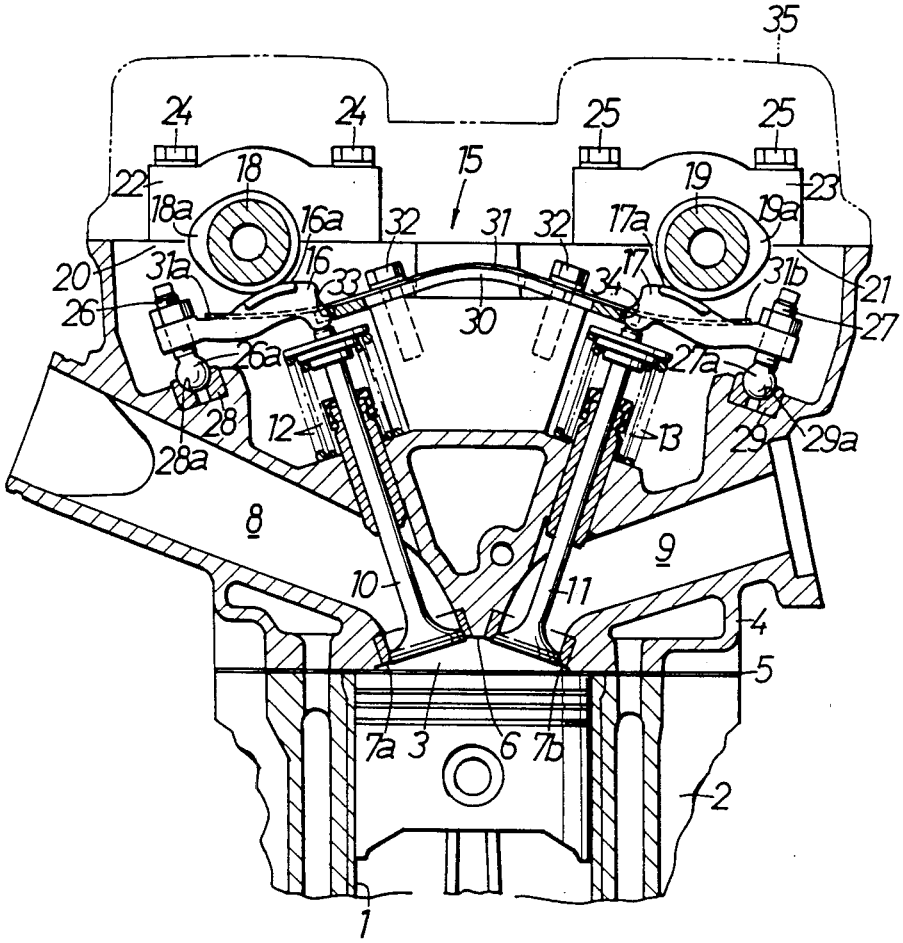
FIGS. 2 and 3 are sectional views taken along lines II—II and III—III of FIG. 1.

Incidentally, reference numeral 35 appearing in FIG. 2 designates a head cover secured to the upper end of the cylinder head 4 so as to cover the upper part of the valve actuating device 15.

Next, the operation of this embodiment will be described.

During engine operation, when the intake cam shaft 18 rotates and causes one intake cam 18*a* to impart lifting action to its associated intake rocker arm 16, the rocker arm 16 rocks downwardly around its spherical end 26*a* as a fulcrum thereby to open the intake valve 10 against the force of valve spring 12, whereas when the lifting action of the intake cam 18*a* disappears, the intake valve 10 returns to its closed state by the force of the valve spring 12 and simultaneously the intake rocker arm 16 rocks upwardly. On the other hand, rotation of the exhaust cam shaft 19 causes the exhaust valve 11 to be opened and closed through collaborating action of the exhaust cam 19*a*, the exhaust rocker arm 17 and the valve spring 13 similarly to the case of the intake valve 10 as mentioned above.

During such opening and closing actions of the intake and exhaust valves 10 and 11, the intake and exhaust rocker arms 16 and 17 are always kept in abuttment against the stem ends of associated valves while sliding up and down within the guide grooves 33, 34 of the guide plate 30. Thus, the rocker arms are prevented their oscillating motion in the lateral or sideward direction. Furthermore, since the guide plate 30 is fixed to the cylinder head 4, any lateral load acting on the intake and exhaust rocker arms 16 and 17 can be reliably supported by the cylinder head 4 and the intake and exhaust valves 10 and 11 can remain free from such load. Moreover, due to use of a deadspace defined between adjacent two ignition plugs 14, 14 and opposed respective two intake and exhaust rocker arms 16, 16; 17, 17, a single large guide plate 30 is permitted to be arranged extending over the said four rocker arms 16, 16; 17, 17, leading to a simplified structure and an improved assemblability.

In addition, respective intake and exhaust rocker arms 16 and 17 are urged downwards at all times by the press arms 31*a*, 31*b* of vibration-proof spring 31, as a result of which even at the time of valve-closing operation the spherical ends 27*a*, 27*a* can be prevented from floating up from the spherical recesses 28*a*, 29*a*. This contributes to an effective prohibition of vertical vibration of the rocker arms 16, 17. Also in this case, the deadspace present among the adjacent two ignition plugs 14, 14 and the respective two intake and exhaust rocker arms 16, 16; 17, 17 opposed to each other is utilized for disposition of a single large vibration-proof spring 31 bridged over the four rocker arms 16, 16; 17, 17.

Irrespective of the guide plate 30 and vibration-proof spring 31 being disposed in a common place, they are advantageously fixed in a unitarily superposed fashion to the cylinder head 4 by bolts 32, 32, which by no means obstructs the simplification in structure and the assemblability improved in the invention.

What is claimed is:

1. A valve actuating device of an internal combustion engine, including a plurality of intake rocker arms disposed between a plurality of parallel-arranged intake valves and an intake cam shaft adapted to drive and open said intake valves, and a plurality of exhaust rocker arms disposed between a plurality of exhaust valves opposed to said intake valves and an exhaust cam shaft adapted to drive and open said exhaust valves, said intake and exhaust rocker arms being pivoted at base ends thereof to a cylinder head of the engine in a freely oscillating manner, respectively, wherein a guide plate is fixed to said cylinder head at a position between adjacent two of said intake rocker arms and two of said exhaust rocker arms opposed to said two intake rocker arms, said guide plate being provided with guide grooves with which said four intake and exhaust rocker arms engage at tip ends thereof in a manner slidable only in an opening and closing direction of the valves.

2. A valve actuating device according to claim 1, wherein said internal combustion engine has a plurality of cylinders and said guide plate is fixed to the cylinder head at a position between adjacent two cylinders.

3. A valve actuating device according to claim 1, wherein the base ends of said intake and exhaust rocker arms are pivotally carried by supporting members on the cylinder head, respectively, and a vibration-proof spring in the shape of a leaf spring is fixed to the cylinder head at a position between said adjacent two intake rocker arms and said opposing two exhaust rocker arms, said vibration-proof spring being formed with four press arms for resiliently biasing said four rocker arms toward their associated supporting members, respectively.

4. A valve actuating device according to claim 3, wherein said guide plate and said vibration-proof spring are superposed one on the other and are unitarily mounted to the cylinder head by common fixing means.

* * * * *